US005325653A

United States Patent [19]

Boyd

[11] Patent Number: 5,325,653

[45] Date of Patent: Jul. 5, 1994

[54] CONTAINER FILLING APPARATUS

[76] Inventor: Jerry L. Boyd, 2521 Sutton Pl., Bakersfield, Calif. 93309

[21] Appl. No.: 990,176

[22] Filed: Dec. 14, 1992

[51] Int. Cl.[5] ..... B65B 5/10; B65B 39/00

[52] U.S. Cl. ..... 53/248; 53/250; 53/502; 141/83; 141/128; 141/192; 177/53; 177/123

[58] Field of Search ..... 33/74, 237, 240, 248, 33/250, 502; 141/83, 128, 134, 192, 193; 177/52, 53, 121, 122, 123, 54

[56] References Cited

U.S. PATENT DOCUMENTS

| | | | |
|---|---|---|---|
| 2,896,384 | 7/1959 | Carlsen et al. | 53/248 |
| 3,229,444 | 1/1966 | Rouse | 53/248 |
| 3,416,619 | 12/1968 | McClusky | 53/248 |
| 3,454,149 | 7/1969 | Nignelli et al. | 53/250 |
| 3,627,101 | 12/1971 | McClusky . | |
| 3,720,039 | 3/1973 | Warkentin | 53/502 |
| 3,814,196 | 6/1974 | McClusky | 177/54 |
| 4,010,595 | 3/1977 | Boyd | 53/502 |
| 4,600,065 | 7/1986 | Morris | 53/250 |
| 4,965,982 | 10/1990 | Jesperson et al. | 53/248 |

*Primary Examiner*—W. Donald Bray

*Attorney, Agent, or Firm*—William P. Green

[57] ABSTRACT

A machine for filling fruit or other items into containers, and including a conveyor for feeding items to a location from which they are dropped into a container, with a member being provided near the discharge end of the conveyor for contacting the items as they fall downwardly from the conveyor and preventing or reducing damage thereto. The member may be actuable between an active position for contacting the falling items and a retracted position. The member may be inclined to deflect the falling items along an inclined path into the container, and is preferably cushioned. The mentioned conveyor fills the container up to a predetermined partially filled condition, with the final few items being delivered to the container by a second conveyor. The second conveyor is adjacent the first, and delivers items to the container at a second location along its path of movement, and is driven at two speeds to deliver items first at a relatively fast pace and then at a slower rate. The second conveyor preferably advances gradually upwardly relative to the first conveyor, and then gradually downwardly to its discharge end. The conveyors are supported by two support columns and are vertically adjustable relative thereto.

14 Claims, 5 Drawing Sheets

FIG. 4
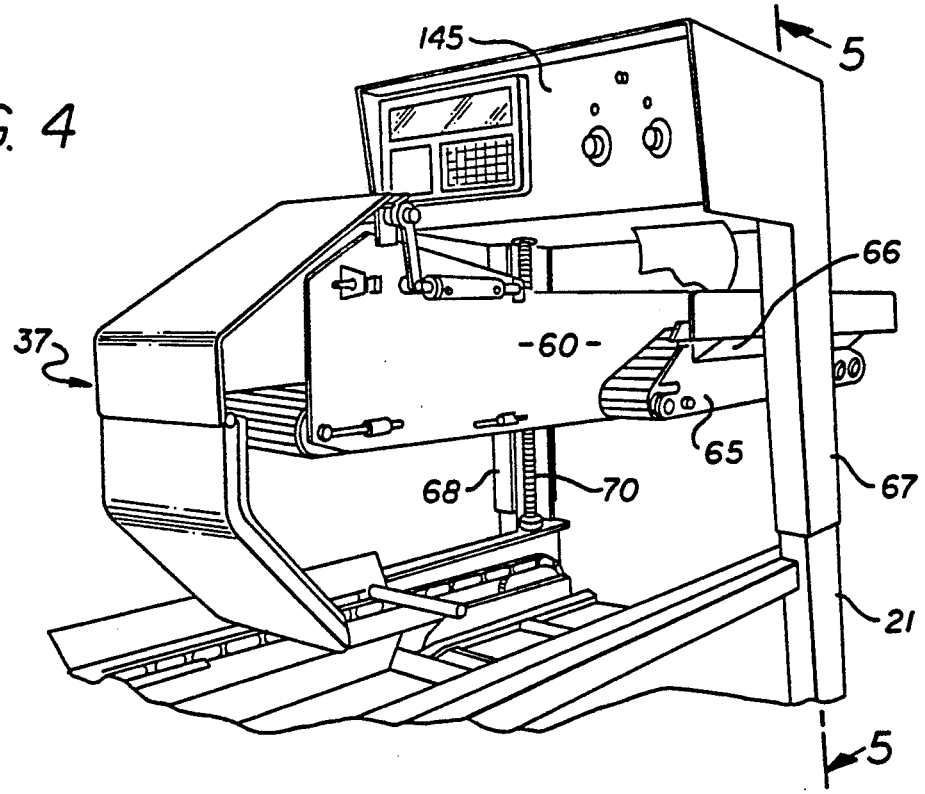
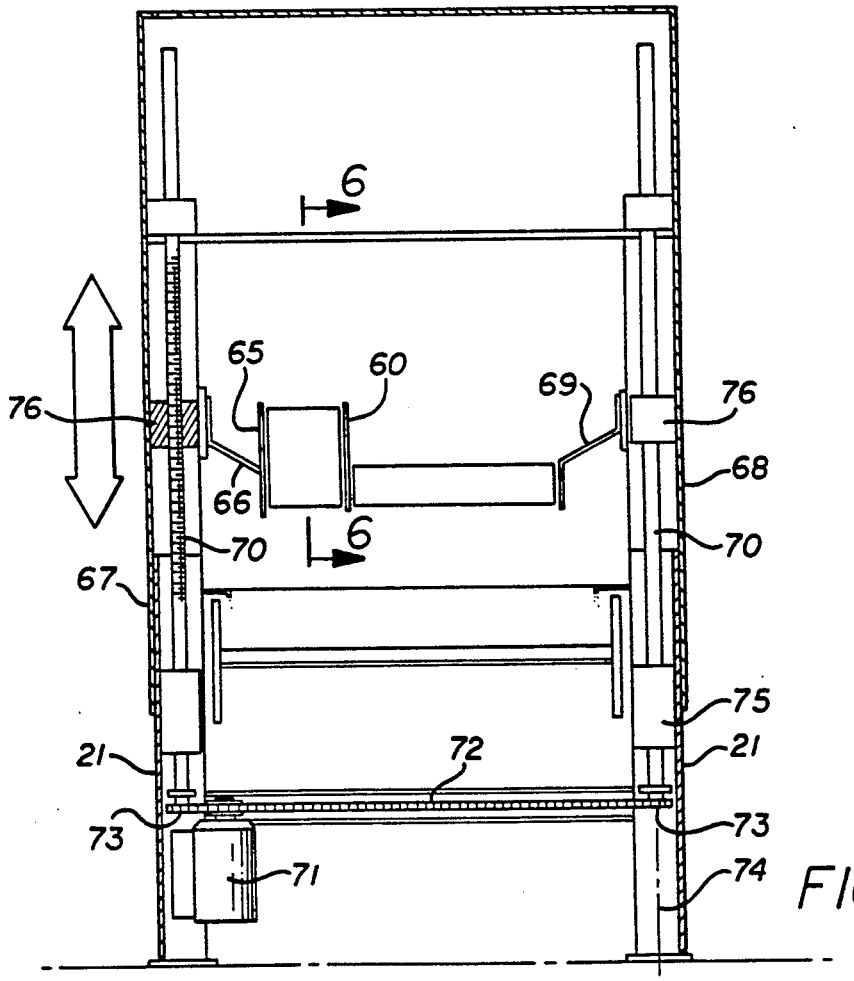
FIG. 5

CONTAINER FILLING APPARATUS

This invention relates to apparatus for filling items into containers, and will be described primarily as applied to the filling of produce into boxes.

BACKGROUND OF THE INVENTION

Machines have been provided in the past for filling produce into boxes by advancing the boxes along a conveyor path and dropping the produce from a mechanized feed conveyor or conveyors into the open boxes at a location or locations along the path. Two such feed conveyors may be utilized, including a main feed conveyor delivering produce into a box or other container at a first filling position and to a predetermined partially filled condition, and a second feed conveyor acting to deliver a final few items into the box at a second position. Scales at the two positions may determine by weight the extent to which the boxes are filled at each of the two locations. The boxes are normally advanced between their different positions by endless conveyor chains extending along opposite sides of the box path and having arms which project inwardly behind the boxes to move them. A machine of this general type is shown in U.S. Pat. No. 3,416,619 issued Dec. 17, 1968 to Stanley A. McClusky on "Means And Method For Rapidly Filling Receptacles".

SUMMARY OF THE INVENTION

The general purpose of the present invention is to provide an improved machine of the above discussed type which is capable of filling boxes or other containers with fruit, vegetables, or the like more efficiently than in the prior art machines, and with greater reliability and less chance of injury or damage to the produce. These results are attained by incorporation into the machine of a number of unique features illustrated in the accompanying drawings and described below.

In order to prevent or reduce damage to fruit, vegetables, or other items being handled, a machine embodying the invention includes a unit which is positioned to be contacted by the items as they fall downwardly from a feed conveyor into a box, in a manner breaking the severity of the fall and thus prevent the damage which usually results when falling items strike the bottom of a box. This unit may be mounted for movement between an active position in which it projects into the path of the falling produce, and a retracted position in which it avoids interference with advancement of the box beyond the location at which it is partially or completely filled by that particular feed conveyor. The unit is preferably cushioned to minimize the possibility of damage to the produce upon contact with the unit, and may be inclined to direct the produce along a correspondingly inclined path further reducing any chance of damage.

The produce contacting unit may be formed of two sections, with a lower one of the two sections being pivotally movable relative to the upper section to enable deflection of the lower section by a moving box. Preferably, actuation of the unit between its active and retracted positions is controlled by a scale which acts when the box has been filled to a predetermined partially filled condition to elevate the unit to its retracted position, with the filling continuing after upward movement of the unit until the box is filled to a predetermined greater extent. The machine may then advance the box to a next successive position for an accurately weighed final filling operation by the final feed conveyor.

Certain features pertaining to the final feed conveyor and its relationship to the main feed conveyor are of importance in increasing the accuracy of the ultimate weight of the filled box, and in preventing jamming or clogging of produce on or near the conveyors. The relationship is such as to minimize the possibility of overloading of the second conveyor with too much produce, and permit excess produce to fall laterally without damage from the second conveyor to the main feed conveyor. To attain these results, the second conveyor has its produce pick-up end at a level near the level of the main feed conveyor, and then advances gradually upwardly relative to the main feed conveyor as it advances toward the discharge ends of the conveyors. The excess produce falls laterally from the second conveyor onto the main feed conveyor as the second conveyor advances upwardly. After reaching a predetermined elevated location, the second conveyor may return back downwardly as it approachs its discharge end.

Both of the feed conveyors may be supported by two support columns located at opposite sides of the box path and at opposite sides of these two conveyors. The main feed conveyor projects as a cantilever from between these two columns. The two conveyors are adjustable upwardly and downwardly relative to the box path, to enable boxes of different sizes and types to be filled, but with both conveyors being supported entirely by the two columns in the different vertically adjusted positions of the conveyors.

BRIEF DESCRIPTION OF THE DRAWINGS

The above and other features and objects of the invention will be better understood from the following detailed description of the typical embodiment illustrated in the accompanying drawings, in which:

FIG. 4 is a fragmentary perspective view of the machine as seen from the left end of FIG. 1;

FIG. 5 is a right end view taken on line 5—5 of FIG. 4;

DESCRIPTION OF THE PREFERRED EMBODIMENT

Figure 1:
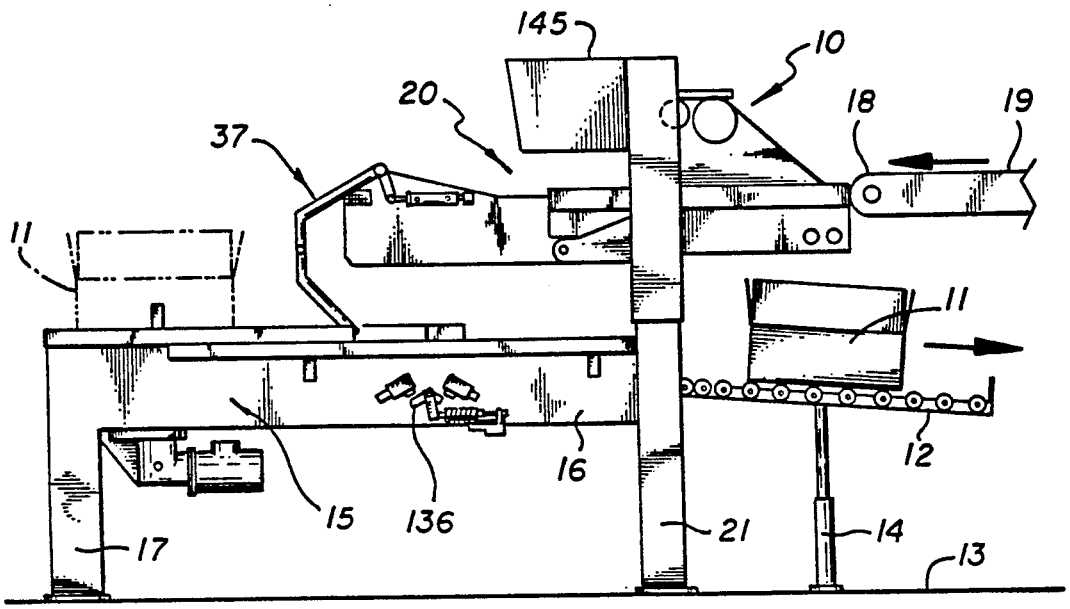
FIG. 1 is a side view of a machine constructed in accordance with the invention for filing produce into boxes.

Referring first to FIG. 1, there is illustrated at 10 in that figure a machine for filling produce, such as pears, apples, peaches, or the like, into a series of rectangular boxes 11, which are initially placed in the machine in the position of the box illustrated near the left end of FIG. 1, and which leave the machine in filled condition on an exit conveyor 12 supported from the floor 13 on a leg structure represented at 14. The machine includes a frame 15 having a main horizontally extending portion 16 along which the boxes move rightwardly in FIG. 1, and typically having four legs 17 supporting the frame from the floor. The produce to be filled into the boxes is delivered to the machine by a conveyor 18 which may take the form of an endless belt having an upper run 19 moving leftwardly to deliver the produce to the machine. This produce is received by a feed assembly 20 which delivers the produce into the boxes, and which is supported in cantilever fashion by vertical columnes 21 and for upward and downward adjustment relative thereto.

Figure 6:
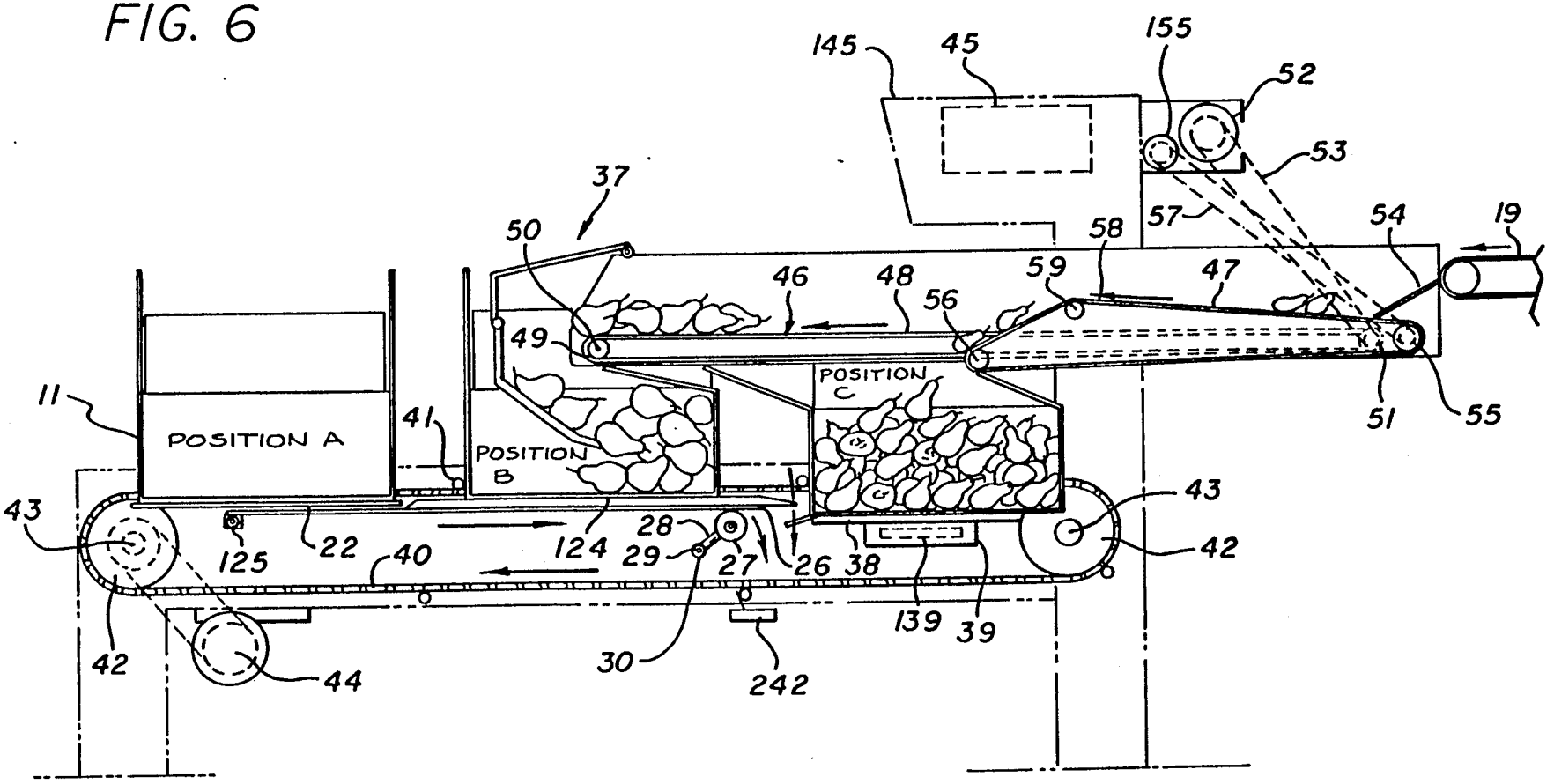
FIG. 6 is an enlarged vertical section through the machine taken on line 6—6 of FIG. 5.

As seen in FIG. 6, the boxes 11 are advanced from left to right through the machine, and between three different positions identified in FIG. 6 as Positions A, B and C, respectively. The boxes are initially placed in the machine in position A by an operator or by a box feed mechanism (not shown). In position A, the bottom of the box is supported on a horizontal plate 22, which may be rectangular and of a size just slightly larger than the size of the horizontal bottom wall 23 of the box. Plate 22 is located between two opposite side walls 24 and 25 of portion 16 of frame 15.

Each box is almost filled while in position B, and the filling is completed in position C. In position B, the box is supported on horizontal plate 124, which is supported pivotally at its left end by a hinge 125 to allow upward and downward swinging movement of the right end 26 of plate 124 about a horizontal axis at the location of hinge 125. Near its right end, the underside of plate 124 engages a roller 27 which is carried by an arm 28 for swinging movement about a horizontal axis 29. Downward swinging movement of roller 27 acts to turn a shaft 30 about axis 29 against the tendency of a spring 32 located at the outside of the frame. More particularly, spring 32 acts against an arm 33 connected to shaft 30 at the outside of the frame, to enable plate 124, spring 32, and the related parts to function as a scale acting to weigh the box at position B and the produce filled into the box at that location.

Two microswitches 34 and 35 mounted at the outside of the frame are actuated by two arms 36 and 136 connected to shaft 30. Switch 34 may be normally closed by arm 36 and remain closed when a box at position B is empty and until it has been filled to a predetermined critical weight. For example, switch 34 may open when the weight of a box and its contents at position B indicates that the box has been sixty percent filled, at which time the switch may open and function to automatically actuate a delivery unit 37 from the active position of FIG. 8 to the retracted position of FIG. 9. As the filling continues with unit 37 in its FIG. 9 position, plate 24 is actuated farther downwardly against the resistance of spring 32 to ultimately actuate the second switch 35, which then functions to automatically stop the delivery of produce to the box. The box at that time may typically be about ninety percent full. In that partially filled condition, the box is advanced to position C, in which it is supported by another horizontal plate 38, which rests on a weight responsive scale unit 39 to determine when the box reaches a completely filled weight at which all delivery of produce to the box is halted.

The boxes are fed successively through the positions A, B and C by two identical endless feed chains 40 which are received at opposite sides of the box path, and which carry parallel horizontal rods 41 projecting inwardly from the chains to locations behind the lower portions of the boxes as seen in FIG. 6. The chains are mounted by rollers or wheels 42 at opposite ends of the machine mounted to turn about two parallel horizontal axes 43 and driven by an electric motor 44. An electrical control unit 45 within an upper housing 145 controls the operation of motor 44 and other portions of the apparatus in accordance with the actuation of scale switches 34 and 35 and scale 39 to cycle the boxes through their various positions and through the machine in the manner later to be discussed.

The produce feed mechanism 20 includes a main feed conveyor 46 for delivering produce into a box at position B, and a second feed conveyor or "dribbler" 47 which delivers the final few items of produce into a box at position C. Conveyor 46 is an endless belt having an upper horizontal run 48 which moves from right to left in FIG. 6. Belt 46 extends at its left end about a horizontal roller 4.9 turning about a horizontal axis 50. At its right end, belt 46 extends about a second similar roller 51 turning about a horizontal axis parallel to axis 50 and driven rotatively by a motor 52 through a belt or chain drive represented at 53. The produce is delivered from the previously mentioned conveyor 18 onto an inclined plate 54 which deposits the fruit onto the upper run of belt 46 and onto the upper run of belt 47. At the left end of conveyor 46, the produce falls downwardly into a box at position B.

Figure 2:
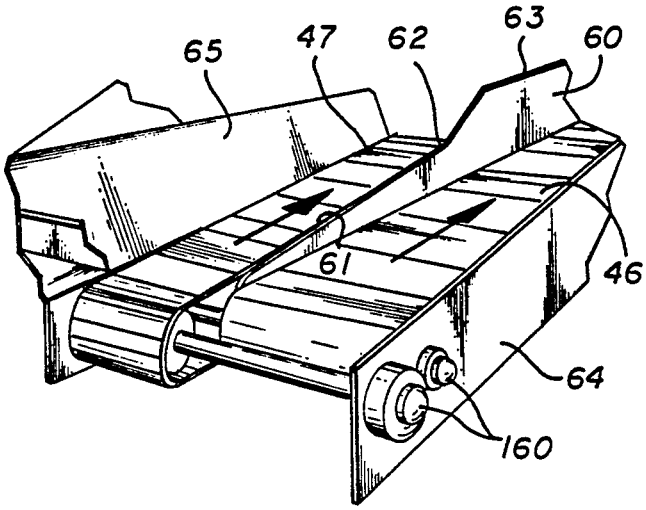
FIG. 2 is a fragmentary perspective view taken from the right end of FIG. 1 and showing the two produce feeding conveyors of the machine.
Figure 3:
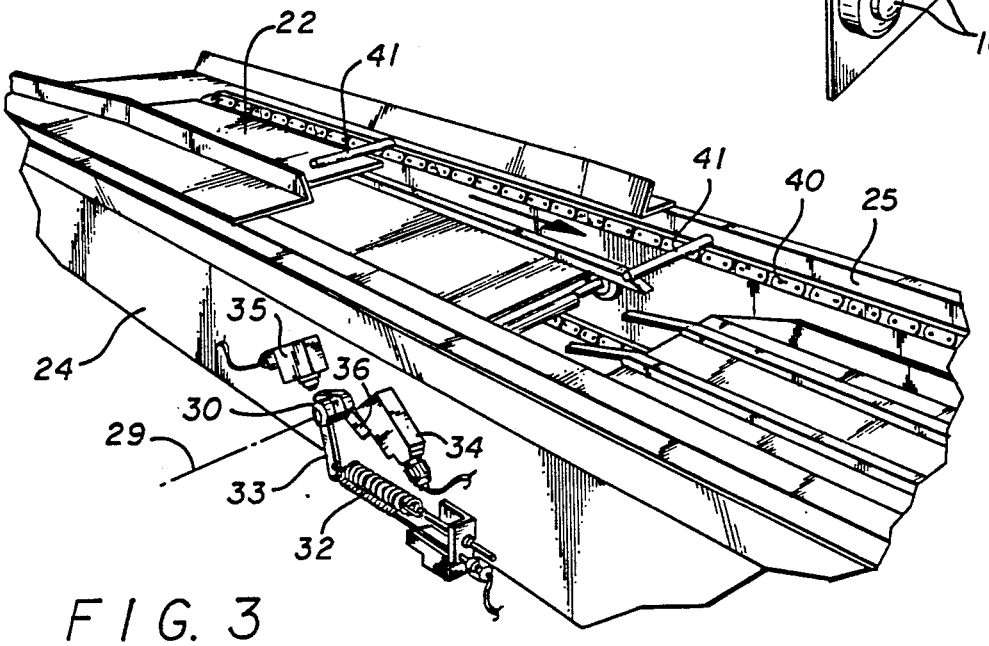
FIG. 3 is a fragmentary perspective representation of the apparatus for advancing a series of boxes through the machine.
Figure 10:
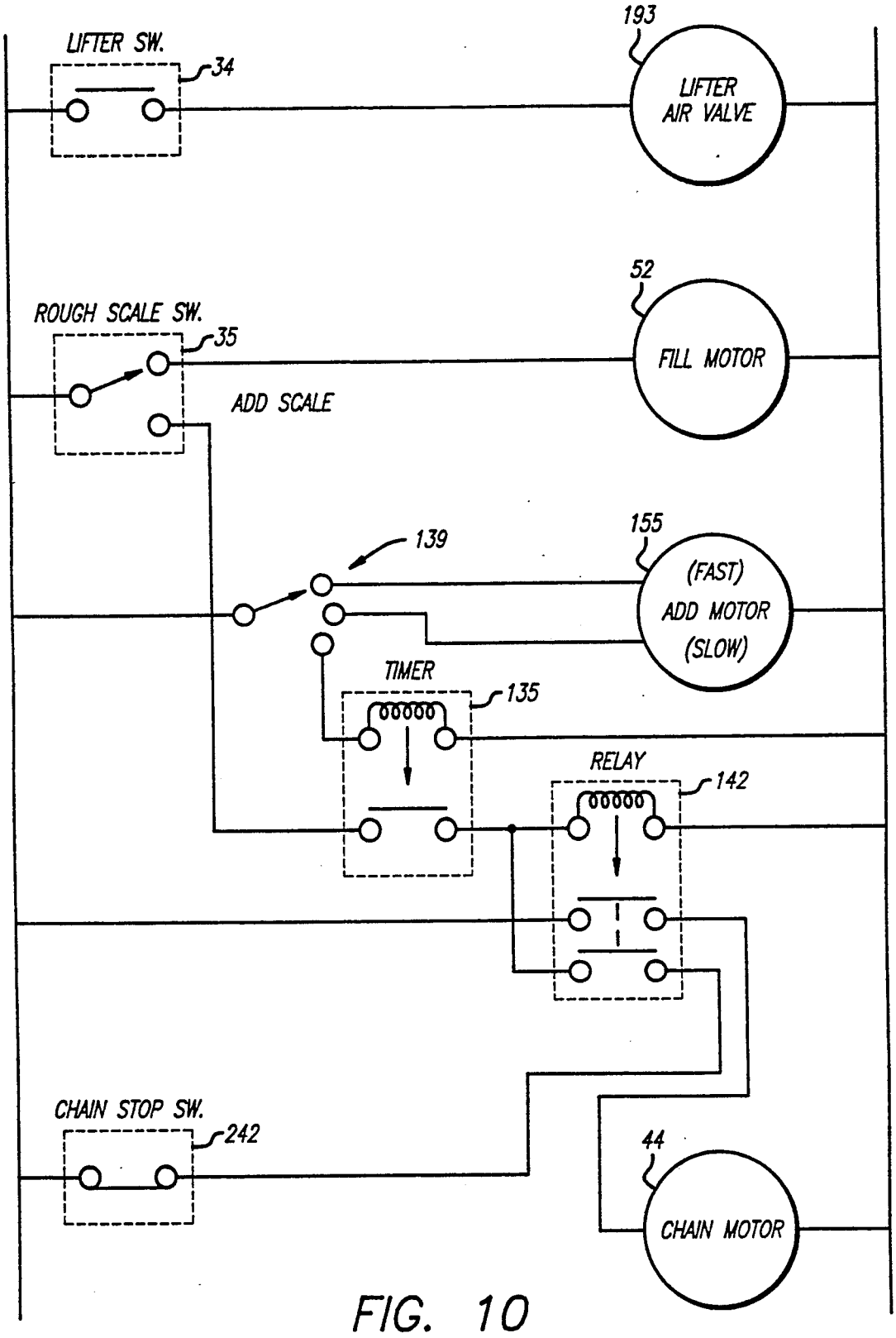
FIG. 10 is a diagram showing the electrical circuit of the machine.

The second produce feed conveyor 47 may be an endless belt located closely adjacent belt 46 and to the left of belt 46 as seen in FIG. 2. At its right end as viewed in FIG. 6, conveyor belt 47 extends about roller 55 which turns about a horizontal axis, and at its left end conveyor 47 extends about a second similar roller 56. Roller 55 is driven rotatively by a motor 155 through a belt or chain 57 to advance the upper run 58 of belt 47 leftwardly as viewed in FIG. 6. At the left end of belt 47, produce falls downwardly into a box at position C. Motor 155 is a two speed motor, to drive dribbler conveyor 47 at a first relatively fast speed upon initial energization of the motor, and then at a slower speed for delivery of a few final items into the box at position C. The motor is actuated between these two different speed conditions by scale 39 and a three position switch 139 controlled thereby (FIG. 10).

At its right end, the upper run 58 of the dribbler conveyor 47 is at approximately the same level as the upper run 48 of conveyor 46, and preferably is substantially exactly aligned horizontally with run 48. As the upper run 58 of dribbler conveyor 47 advances leftwardly from the location of roller 55, run 58 gradually advances upwardly at a slight inclination to a level substantially above the level of the upper run 48 of the adjacent conveyor 46, and to a location at which run 58 passes about another roller 59 turning about a horizontal axis parallel to the axes of end rollers 55 and 56. Leftwardly beyond the location of roller 59, the upper run 58 of belt 47 advances gradually downwardly to the location of roller 56, at which the produce falls downwardly into the box at position C.

Conveyor belt 47 is narrower than belt 46, and preferably is of a width to advance the pears, apples, or other produce to the box at position C in single file, to thus drop only one such item into the box at a time and in that way attain a very accurate measurement of the contents of the box at position C. Any excess produce on belt 47 may fall laterally from that belt onto the adjacent feed belt 46 for delivery thereby to a box. A vertical plate 60 located between the two produce feed conveyors 46 and 47 may have an edge 61 which is inclined gradually upwardly at the level of the upper surface of conveyor 47 to a location 62, beyond which plate 60 has a portion 63 of greater height maintaining produce at that location on conveyor 46 against lateral movement off of that conveyor. A vertical wall 64 extends along the outer side of conveyor 46, parallel to the wall 60 between the conveyors, and a third wall 65 extends along the outer side of conveyor 47, parallel to walls 60 and 64.

The rollers 49, 51, 55, 56 and 59 which mount conveyors 46 and 47 are journalled in bearings 160 carried by plates 60, 64 and 65. The three plates or walls 60, 64 and 65 are suitably attached together as a horizontally elongated rigid framework of assembly 20, and are rigidly welded or otherwise attached to two vertical members 67 and 68 connected telescopically to columns 21 at the opposite sides of the box path. More particularly, as seen in FIGS. 4 and 5, plate 65 may be attached by a connector structure 66 to vertical member 67, and plate 64 may be rigidly attached by a structure 69 to vertical member 68. The housing 145 of control unit 45 extends between and rigidly interconnects the upper ends of the two vertical members 67 and 68.

Columns 21 may be of hollow rectangular configuration, with the vertical members. 67 and 68 being of similar but slightly larger rectangular hollow configuration, so that the members 67 and 68 move telescopically upwardly and downwardly relative to columns 21 to allow for vertical adjustment of the entire assembly 20. Adjusting screws 70 extend vertically within the two telescopic assemblies, and are driven rotatively in unison by a motor 71 through a drive chain 72 and sprokets 73 connected to the lower ends of the screws. The screws are journalled for rotation within the columns and members 67 and 68 about vertical axes 74, and are retained by bearings 75 against vertical movement relative to columns 21. Threaded nuts 76 connected rigidly to members 67 and 68 threadedly engage screws 70 to actuate members 67, 68, and the cantilevered assembly 20 upwardly and downwardly relative to the base frame 15 of the machine.

Figure 7:
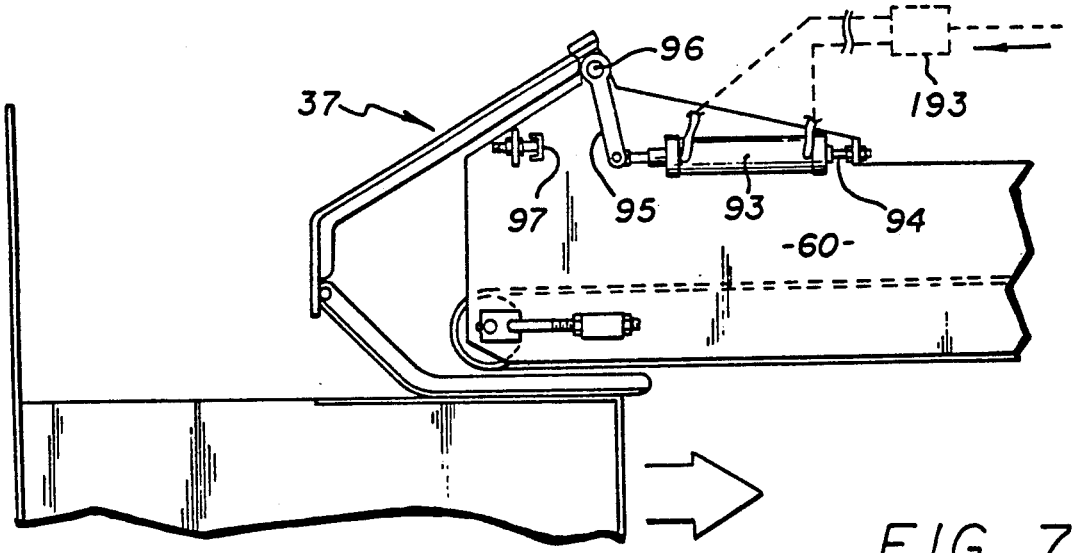
FIGS. 7, 8 and 9 are three further enlarged fragmentary representations of the delivery unit which directs the produce into a box, with the delivery unit being shown in three different positions.

The produce delivery or deflecting unit 37 acts to engage the produce as it falls downwardly from the left end of main produce feed conveyor 46 into a box at position B in FIG. 6, and prevent damage to the produce as it enters the box. Unit 37 includes a first element 77 having a rigid backing plate 78 and a resiliently deformable cushion 79. Unit 37 also includes a second element 80 which is pivotally connected to element 77 at 81 for relative swinging movement between the different positions of FIGS. 7, 8 and 9. Element 80 may include a rigid backing plate 81 having a resiliently deformable cushion or pad 82 covering its entire right surface as viewed in FIGS. 7 through 9. Plate 78 of element 77 is mounted pivotally at 83 for swinging movement about a horizontal axis 84 between the lower active position of FIGS. 7 and 8 and the upper retracted position of FIG. 9. The pivotal connection at 81 between elements 77 and 80 mounts element 80 for swinging movement relative to element 77 about a horizontal axis parallel to axis 84 and between the upwardly deflected position of FIG. 7 (see broken line position of FIG. 9) and the active position of FIG. 8 (see full line position of FIG. 9). The clockwise pivotal movement of element 80 relative to element 77 is limited in the relative position of FIGS. 8 and 9 by engagement of an upper portion of plate 81 with a downwardly projecting portion 85 of plate 78.

Figure 8:
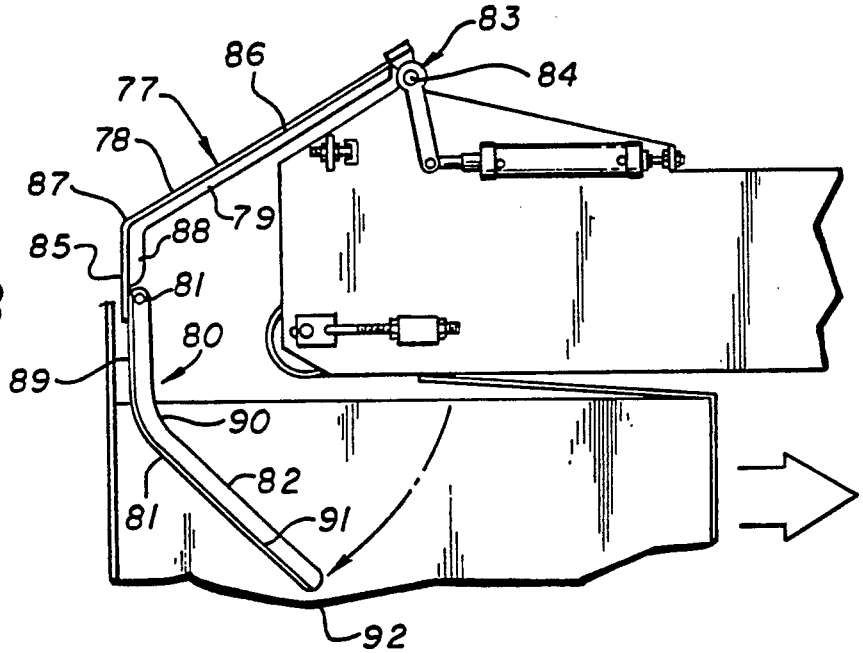

In the FIG. 8 position of unit 37, its upper element 77 may be described as having a downwardly and leftwardly inclined main portion 86 merging at 87 with a downwardly projecting portion 88 to which element. 80 is connected. In that same FIG. 8 position, element. 80 may be described as having a downwardly projecting portion 89 merging at 90 with a downwardly and rightwardly inclined portion. 91. In the FIG. 8 position, the lower extremity 92 of portion 91 of element 80 may be near or engage the bottom wall of a box 11 in position B.

Figure 9:
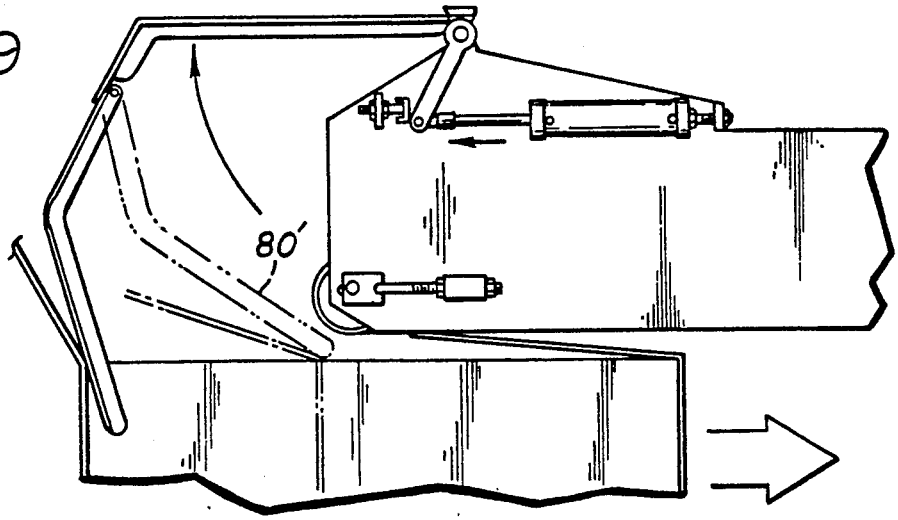

Unit 37 is actuated between the active position of FIG. 8 and the upwardly retracted position of FIG. 9 by a piston and cylinder mechanism 93 or other power actuator which is connected at one end 94 to wall 60 of assembly 20, and is connected at its opposite end to an arm 95 rigidly attached to shaft 96 of element 37. The retracting movement of unit 37 may be limited by engagement of arm 95 with a stop 97 carried by plate or wall 60.

With reference now to the circuit diagram of FIG. 10, it will be noted that switch 34 is connected into the power circuit of an electrically operated valve 193 which controls the delivery of pressurized air or other fluid from a supply of such fluid to piston and cylinder mechanism 93. When switch 34 is opened by the presence of a predetermined weight on scale plate 124, valve 193 is in a condition to deliver air to the right end of cylinder 93 and thereby hold delivery unit 37 in its upper retracted position of FIG. 9. When switch 34 is closed (less than the predetermined critical weight on scale plate 124), valve 193 is in a condition to deliver air to the left end of cylinder 93, thereby lowering delivery 37 to the active position of FIG. 8. Switch 35 is a single pole double throw switch whose movable contact is in the upper position of FIG. 10 closing the circuit to motor 52 when there is no weight on scale plate 124 and until the weight on that scale reaches a predetermined value, at which time the movable contact of switch 35 swings downwardly to close a circuit to a timer 135. A switch 139 actuated by scale 39 has a movable contact with three positions. In the upper of those three positions, switch 139 closes a first circuit to dribbler motor 155 causing operation of that motor and conveyor 47 at the faster of their two speeds. In the next lower position of the movable contact of switch 139, that switch closes a second circuit to motor 155 which drives the motor at a slower speed. In the lowermost of its three positions, the movable contact of switch 139 closes a circuit to the coil of timer 135, which is connected to a relay 142, chain drive motor 42, and a chain stop switch 242 in the manner illustrated in FIG. 10. The chain stop switch 242 may be positioned as shown in FIG. 6, to be actuated to an open condition by one of the box advancing arms 41 when the boxes have been advanced by chains 40 and arms 41 to the predetermined positions A, B and C illustrated in FIG. 6.

To now describe a cycle of operation of the machine, assume that three boxes are in the positions A, B and C of FIG. 6, with the box at position B being partially filled, and the box at position C being completely filled. The weight of the partially filled box at position B is great enough to cause the scale mechanism which supports it and which includes plate 124 to open switch 34, causing delivery unit 37 to be held in its upper retracted position of FIG. 9, and the weight on plate 124 is also great enough to swing the movable contact of switch 35 to the lower of its two positions halting main produce feed conveyor 46. The weight of the box at position C is great enough to actuate switch 139 of scale 39 to the lower of its three positions, halting motor 155 and conveyor 47. The lower contact of switch 139 energizes timer 135, which after a short delay period closes a circuit energizing relay 142. Such actuation of the relay closes a circuit to chain motor 44, commencing operation of chains 40 to advance the boxes from left to right in FIG. 6, and also closes a holding circuit to the relay continuing advancement of the chains and boxes until switch 242 is actuated to break the holding circuit and stop the boxes in the FIG. 6 positions.

The empty box at position A thus moves to position B, while the partially filled box at position B moves to position. C, and the completely filled box at position C moves onto exit conveyor 12. During such advancement of the boxes between positions, unit 37 remains in the upwardly retracted position of FIG. 9. In that position, the upper element 77 of unit 37 is completely above the level of the boxes. The lower element 80 of unit 37 may still project downwardly far enough to be received partially within a box, but as the box from position A moves rightwardly it deflects element 80, as to the position represented in broken lines at 80', so that the box may move to position B without interference by element 80.

As each of the boxes advances one position to the right, the reduction in weight on scale plate 124 closes switch 34 to deliver pressurized fluid to the left end of piston and cylinder mechanism 93 and thereby move delivery unit 37 downwardly to the FIG. 8 position. The reduction in weight on scale plates 124 and 38 also returns the movable contacts of switches 35 and 139 to their upper positions of FIG. 10 energizing motors 52 and 155 and advancing the upper runs of conveyors 46 and 47 leftwardly as viewed in FIG. 6. The produce from conveyor 46 falls downwardly into the initially empty box at position B, and the produce from conveyor 47 falls downwardly from the left end of that conveyor into the box at position C.

The produce leaving the left end of conveyor 46 may engage the cushioned portion of element 77, and falls downwardly into engagement with the cushioned portion of element 80, and is deflected along an inclined path by the inclined portion of element 80, in a manner directing the produce to the bottom of the box while avoiding damage thereto. When the box at position B reaches a predetermined partially filled condition, say sixty percent filled, downward deflection of the scale plate 124 opens switch 34 and delivers pressurized fluid to the right end of cylinder 93, with resultant actuation of unit 37 upwardly from the active position of FIG. 8 to the retracted position of FIG. 9. Switch 35 however remains in its upper position and does not halt operation of motor 52 and conveyor 46 at this stage, but rather continues the operation of that conveyor to deliver additional produce into the box at position B until the scale plate 124 and connected mechanism actuate switch 35 to its lower position stopping the operation of conveyor 46. In that condition, the box at position B may typically be about ninety percent filled. After the box at position B has reached this desired almost completely filled condition, and the box at position C has been completely filled and motor 155 has been stopped by actuation of switch 139 to the lower of its three positions, chain motor 42 commences another cycle of operation with advancement of the boxes to their next successive positions.

With regard to the functioning of the three position switch 139 and motor 155, it is noted that when motor 155 and its driven conveyor 55 are first energized upon arrival of a partially filled box at position C, motor 155 drives conveyor 47 at its faster speed, to deliver produce into the box at position C until the scale 39 indicates that a predetermined weight has been attained, say a weight corresponding to a ninety-eight percent filled condition of the box. Attainment of that weight swings the movable contact of switch 139 to its middle position, driving motor 155 and conveyor 47 at a slower speed to feed the final few items into the box at position C. when the scale 39 senses a weight corresponding to a one hundred percent filled condition, switch 139 moves to its lower position and stops conveyor 47. When both conveyors 46 and 47 have been stopped because their respective scales have sensed the properly filled conditions of the boxes at positions B and C, the apparatus is as previously discussed in condition for advancement of each box to the next successive position.

If it is desired to fill boxes which have a greater vertical dimension than those illustrated, or a smaller vertical dimension than those illustrated, motor 71 is energized to cause screws 70 to actuate assembly 20, including the cantilevered conveyors 46 and 47 and the connected mechanism, upwardly or downwardly to a changed height for delivery of produce at a proper level to fall into the boxes of the new height. Regardless of the height, of box utilized, the delivery or deflecting unit 37 functions in the manner described to prevent damage to the produce as it falls downwardly into the boxes at position B.

While a certain specific embodiment of the present invention has been disclosed as typical, the invention is not limited to this particular form, but rather is applicable broadly to all such variations as fall within the scope of the appended claims.

I claim:

1. Apparatus for filling items into containers, comprising:

a support on which a container is received during a filling operation;

a conveyor for feeding items to a location from which they are dropped into a container on the support;

a deflecting and cushioning device movable upwardly and downwardly between a lower active position in which the device projects downwardly into a container on said support and is contacted by items falling from the conveyor toward the bottom of the container, to prevent or reduce damage to the items, and an upwardly retracted position;

said device including an upper panel mounted for upward and downward swinging movement, and a lower panel connected to said upper panel for movement upwardly and downwardly therewith and for pivotal movement relative to the upper panel;

said lower panel projecting downwardly beneath said upper panel and having a portion which is received within the container in said lower position of the device and which has an upwardly facing inclined cushioned surface onto which said items fall from the conveyor for deflecting the items along an inclined path toward the bottom of the container; and actuating means for swinging said upper panel of said device upwardly and downwardly, carrying said relatively movable lower panel.

2. Apparatus as recited in claim 1, in which a container on said support is movable generally horizontally between different positions, said lower panel of said device being deflectible relative to said upper panel by a container during said generally horizontal movement thereof.

3. Apparatus as recited in claim 1, including control means for automatically energizing said actuating means to swing said two panels of said device upwardly toward said retracted position when a container has been filled to a predetermined extent.

4. Apparatus as recited in claim 1, in which said support includes a scale responsive to the weight of a container and its contents, there being means controlled by said scale for automatically energizing said actuating means to swing said two panels of said device upwardly toward said retracted position when the weight of a container and its contents reaches a predetermined value.

5. Apparatus as recited in claim 1, in which said support includes a scale responsive to the weight of a container and its contents; there being means controlled by said scale automatically responsive to attainment of a first partially filled weight of a container and its contents to actuate said device upwardly from said lower position to said retracted position, and subsequently actuable upon attainment of a second more completely filled weight of the container and its contents to halt delivery of items to the container by said conveyor.

6. Apparatus as recited in claim 5, in which a container on said support is movable generally horizontally tally between different positions, said lower panel of said device being deflectible relative to said upper panel by a container during said generally horizontal movement thereof.

7. Apparatus for filling items into containers, comprising:

a first conveyor for advancing a series of containers successively along a predetermined path from a first position to a second position and then to a third position;

a second conveyor for delivering items to a location from which they drop into a container at said second position, to partially fill the container;

a third conveyor for delivering additional items to a location above a container in said third position to complete filing of the container;

a deflecting and cushioning device movable upwardly and downwardly between a lower active position in which the device projects downwardly into a container at said second position and is contacted by items falling from said second conveyor toward the bottom of the container, to prevent or reduce damage to the items, and an upwardly retracted position;

said device including an upper panel mounted for upward and downward pivotal movement about a first generally horizontal axis, and a lower panel connected to said upper panel for movement upwardly and downwardly therewith and for pivotal movement relative to the upper panel about a second generally horizontal axis;

said lower panel projecting downwardly beneath said upper panel and having a portion which is received within a container in said lower position of the device and which has an upwardly facing inclined cushioned surface onto which said items fall from said second conveyor for deflecting the items along an inclined path toward the bottom of the container; and means for automatically actuating said device downwardly to said lower position upon arrival of an empty box at said second position, and for returning said device upwardly to said retracted position when items have been filled into the container at said second position to a predetermined extent.

8. Apparatus as recited in claim 7, including means operable to automatically halt advancement of itsms to a container by said second conveyor when a container at said second position has been filled to a second more completely filled extent.

9. Apparatus as recited in claim 7, in which said actuating means include a scale responsive to the weight of a container and its contents at said second position, and means controlled by the scale for automatically retracting said device upwardly upon attainment of a first predetermined weight, and subsequently automatically actuable upon attainment of a second greater weight to halt advancement of items by said second conveyor to a container in said second position.

10. Apparatus for filling items into containers, comprising:

first conveyor means for advancing a series of containers successively along a path from a first position to a second position at which the containers are partially filled, and then to a third position for completing the fill;

two support columns at opposite sides of said container path near said third position of the containers and beyond said second position;

a main feed conveyor extending from a location between said two columns to a discharge end of the main feed conveyor from which items fall into a container at said second position;

a rigid frame structure carrying said main feed conveyor and supported by said columns and projecting generally horizontally as a cantilever from the location of said columns toward said second position of the containers;

a final feed conveyor located at least partially between said columns and connected to said frame structure and operable to advance items into a container at said third position; and mean supporting said main feed conveyor and said rigid frame structure and said final feed conveyor entirely from said two columns, with said rigid frame structure and said main feed conveyor projecting as a cantilever from the location of said columns to said discharge end of the main feed conveyor from which items fall into a container at said second position;

said supporting means including two vertical members carrying said main feed conveyor and said rigid frame structure and said final feed conveyor and which interfit telescopically with said two columns respectively for vertical adjustment of said members and the carried two feed conveyors and rigid frame structure relative to said first conveyor means and the containers moving along said path, while said members and said two feed conveyors and said rigid frame structure remain completely supported by the two columns in different vertically adjusted positions.

11. Apparatus as recited in claim 10, in which said supporting means include means for actuating said vertical members upwardly and downwardly relative to said two support columns.

12. Apparatus as recited in claim 10, in which said supporting means include two vertical lead screws contained within said columns and said vertical members and operable by rotation to actuate said vertical members and said main feed conveyor and said rigid frame structure and said final feed conveyor upwardly and downwardly relative to said support columns.

13. Apparatus as recited in claim 12, including a deflecting and cushioning device carried by said rigid frame structure at a location spaced from said columns and movable upwardly and downwardly relative to said frame structure and said main feed conveyor between a lower active position in which the device projects downwardly into a container at said second position and is contacted by and deflects and cushions items falling from said main feed conveyor toward the bottom of the container, to prevent or reduce damage to the items, and an upwardly retracted position.

14. Apparatus as recited in claim 10, including a deflecting and cushioning device carried by said rigid frame structure at a location spaced from said columns and movable upwardly and downwardly relative to said frame structure and said main feed conveyor between a lower active position in which the device projects downwardly into a container at said second position and is contacted by and deflects and cushions items falling from said main feed conveyor toward the bottom of the container, to prevent or reduce damage to the items, and an upwardly retracted position.

* * * * *